US009759063B2

(12) United States Patent
Kundam et al.

(10) Patent No.: US 9,759,063 B2
(45) Date of Patent: Sep. 12, 2017

(54) METHOD AND APPARATUS FOR GENERATING PULSES IN A FLUID COLUMN

(71) Applicant: Halliburton Energy Services, Inc., Houston, TX (US)

(72) Inventors: Ravi Kiran Kundam, Hyderabad (IN); Abhay Raghunath Bodake, Pune (IN); Amitkumar Suresh Rawool, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/114,721

(22) PCT Filed: Apr. 4, 2014

(86) PCT No.: PCT/US2014/033043

§ 371 (c)(1),
(2) Date: Jul. 27, 2016

(87) PCT Pub. No.: WO2015/152945

PCT Pub. Date: Oct. 8, 2015

(65) Prior Publication Data

US 2016/0341033 A1 Nov. 24, 2016

(51) Int. Cl.
*E21B 47/18* (2012.01)
*E21B 47/00* (2012.01)

(52) U.S. Cl.
CPC ..... *E21B 47/18* (2013.01); *E21B 47/00* (2013.01); *E21B 47/182* (2013.01)

(58) Field of Classification Search
CPC ..... E21B 47/18; E21B 47/00; E21B 47/182
See application file for complete search history.

(56) References Cited

U.S. PATENT DOCUMENTS

| | | | | |
|---|---|---|---|---|
| 7,417,920 | B2 | 8/2008 | Hahn et al. | |
| 8,138,943 | B2 | 3/2012 | Kusko et al. | |
| 2002/0117306 | A1 | 8/2002 | Hahn et al. | |
| 2005/0117453 | A1 | 6/2005 | Lehr | |
| 2013/0051177 | A1 | 2/2013 | Vecseri et al. | |
| 2013/0076527 | A1* | 3/2013 | Sitka | E21B 47/06 340/854.4 |

FOREIGN PATENT DOCUMENTS

WO WO-2015152945 A1 10/2015

OTHER PUBLICATIONS

"International Application Serial No. PCT/US2014/033043, International Search Report dated Dec. 23, 2014", 4 pgs.
"International Application Serial No. PCT/US2014/033043, Written Opinion dated Dec. 23, 2014", 11 pgs.

* cited by examiner

*Primary Examiner* — Leon Flores
(74) *Attorney, Agent, or Firm* — Hayes and Boone, LLP

(57) ABSTRACT

Method and apparatus for generating fluid pulses in a fluid column, such as within a downhole well, are disclosed. A described example fluid pulse generator utilizes a moveable flow conduit through which at least a portion of a downwardly flowing fluid column will pass. The moveable flow conduit can be moved, such as by pivoting, in and out of registry with other components defining the fluid flow path to provide resistance to flow of a selected duration and pattern, and thereby to generate pressure pulses within the fluid column detectable at the surface. In some examples, magnetic actuators will be used to perform the described pivoting of the moveable flow conduit.

20 Claims, 4 Drawing Sheets

METHOD AND APPARATUS FOR GENERATING PULSES IN A FLUID COLUMN

PRIORITY APPLICATION

This application is a U.S. National Stage Filing under 35 U.S.C. 371 from International Application No. PCT/US2014/033043, tiled on Apr. 4, 2014 and published as WO 2015/152945 A1 on Oct. 8, 2015, which applications and publication are incorporated herein by reference in their entirety.

BACKGROUND

This disclosure relates generally to methods and apparatus for generating pulses in a fluid column, as may be used for telemetry between a surface location and downhole instrumentation within a subterranean well.

The use of pulses in a fluid column within tubular members in a wellbore, typically termed "mud pulse telemetry," is generally well known in the art apart from the particular teachings of this disclosure. Numerous systems have been proposed for generating such pulses in the fluid column, typically broadly referred to as drilling "mud," though the actual fluid may be any well servicing fluid as known in the art. In accordance with this common terminology in the industry, the fluid pulse generating device will be described as a "mud pulse generator." With the clear understanding that this term conveys no implication as to the type, nature, or purpose of the fluid in which the pulses are generated.

Various forms of rotating assemblies have been proposed to produce such fluid pulses, including some having a rotor operable to incrementally rotate to open (or relatively partially open), and close (or relatively partially close), flow fluid passageways to periodically restrict or block the flow, thereby causing periods of pressure build up, and thus the pulses as desired for the telemetry. Other known forms of rotating systems include a rotor which rotates generally continually, and wherein the speed of the rotor is varied to facilitate pulses at a momentary selected frequency to execute a desired communication protocol. Still other known systems utilize linearly operating valves, such as poppet valves, to generate the desired pulses. Each of these systems offers various advantages and disadvantages.

DETAILED DESCRIPTION

The present disclosure addresses new methods and apparatus wherein a member defining a fluid passageway through which the fluid passes is periodically deflected to generate pulses in a desired communication protocol. In the described example methods and apparatus for generating such pulses through angular deflection of a central fluid passageway containing at least a portion of the fluid column.

The following detailed description describes example embodiments of the new mud pulse generator with reference to the accompanying drawings, which depict various details of examples that show how the disclosure may be practiced. The discussion addresses various examples of novel methods, systems and apparatus in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

A mud pulse generator as described herein will be used to generate pulses within a tubular body within a downhole well. One example of such use is for the mud pulse generator to be placed in a drillstring along with MWD (or LWD) tools, to communicate data from the MWD/LWD tools upwardly and to the surface through the fluid column flowing downwardly through the drillstring to exit the drill bit. The pulses will be detected and decoded at the surface, thereby communicating data from tools or other sensors in the bottom hole assembly, or elsewhere in the drillstring. The described example mud pulse generator utilizes a flow conduit through which at least a portion of the downwardly flowing fluid column will pass, and which may be pivoted in and out of registry with other components defining the fluid flow path to provide resistance to flow of a selected duration and pattern, and thereby to generate pressure pulses within the fluid column detectable at the surface. The specific example mud pulse generator addressed herein utilizes a linear conduit as the pivotable flow conduit, and uses magnetic actuators to perform the described pivoting of the linear flow conduit.

Figure 1:
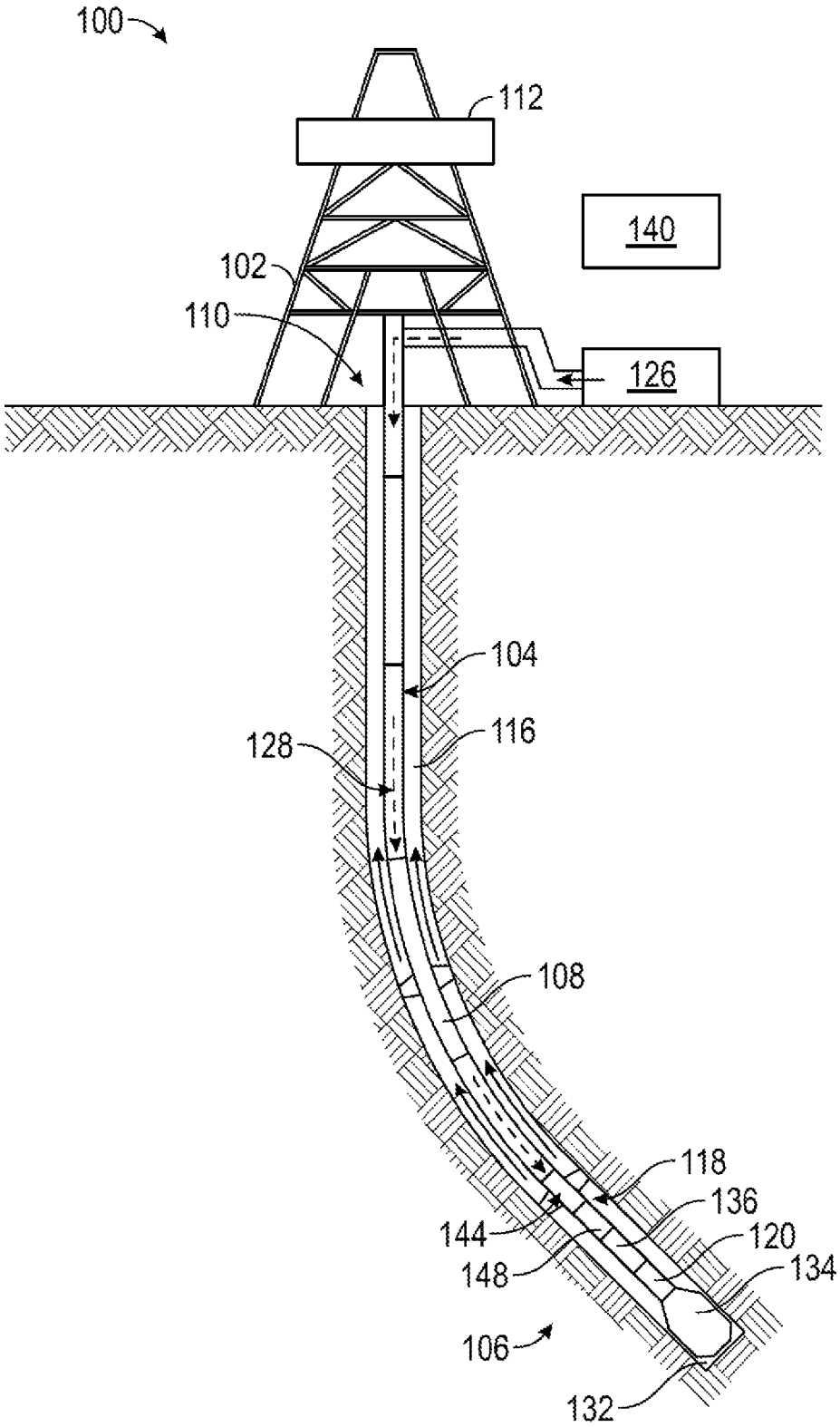
FIG. 1 depicts an exemplary tool string within a wellbore, the tool string including a mud pulse generator in accordance with the present disclosure.

Referring now to FIG. 1, the figure schematically depicts an example directional drilling system 100 configured to form wellbores at a variety of possible trajectories, including those that deviate from vertical. Directional drilling system 100 includes a land drilling rig 102 to which is attached a drill string 104 with a bottom hole assembly 106 (hereinafter BHA), in accordance with this disclosure. The present disclosure is not limited to land drilling rigs, and example systems according to this disclosure may also be employed in drilling systems associated with offshore platforms, semi-submersible, drill ships, and any other drilling system satisfactory for forming a wellbore extending through one or more downhole formations. Drilling rig 102 and associated surface control and processing system 108 can be located proximate well head 110. Drilling rig 102 can also include rotary table 112, rotary drive motor 114, and other equipment associated with rotation of drill string 104 within wellbore 116. An annulus 118 will exist between the exterior of drill string 104 and the formation surfaces defining wellbore 116.

For some applications, drilling rig 102 can also include a top drive unit 120. Blow out preventers (not expressly shown) and other equipment associated with drilling wellbore 116 may also be provided at well head 110. One or more pumps may be used to pump drilling fluid 128 from fluid reservoir 126 to the upper end of drill string 104 extending from well head 110. Return drilling fluid, formation cuttings, and/or downhole debris from the bottom end 132 of wellbore 116 will return through the annulus 118 through various conduits and/or other devices to fluid reservoir 126. Various types of pipes, tubing, and/or other conduits may be used to form the complete fluid paths.

In the depicted example configuration, drill string 104 extends from well head 110 and is coupled with the supply of drilling fluid 128 from reservoir 126. The lower end of drill string 104 includes BHA 106 terminating in drill bit 134 disposed adjacent to end 132 of well bore 116. Drill bit 134 includes one or more fluid flow passageways with respective nozzles disposed therein. Various types of well fluids can be pumped from reservoir 126 to the end of drill string 104 extending from wellhead 110. The well fluid(s) flow through a longitudinal bore (not expressly shown) in drill string 104, and exit from nozzles formed in drill bit 134.

At lower end 132 of wellbore 116, during drilling operations drilling fluid will mix with formation cuttings and other downhole debris proximate drill bit 134. The drilling fluid will then flow upwardly through annulus 118 to return the formation cuttings and other downhole debris to the surface. Various types of screens, filters, and/or centrifuges (not expressly shown) may be provided to remove formation cuttings and other downhole debris prior to returning drilling fluid to reservoir 126.

Bottom hole assembly (BHA) 106 can include various components, for example one or more measurement while drilling (MWD) or logging while drilling (LWD) tools 136, 148 that provide logging data and other information to be communicated from the bottom of well bore 116 to surface equipment 108. In this example string, BHA 106 includes mud pulse generator 144 to provide mud pulse telemetry of such data and/or other information through the fluid column within the drill string to a surface receiver location, for example, at the wellhead 110. Mud pulse generator 144 will be constructed in accordance with the example device of FIG. 2. At the surface receiver location, the pressure pulses in the fluid column will be detected and converted to electrical signals for communication to surface equipment, and potentially from there to other locations.

For example, the communicated logging data and/or other information can be communicated to a data processing system 140. Data processing system 140 can include a variety of hardware, software, and combinations thereof, including, e.g., one or more programmable processors configured to execute instructions on and retrieve data from and store data on a memory to carry out one or more functions attributed to data processing system 140 in this disclosure. The processors employed to execute the functions of data processing system 140 may each include one or more processors, such as one or more microprocessors, digital signal processors (DSPs), application specific integrated circuits (ASICs), field programmable gate arrays (FPGAs), programmable logic circuitry, and the like, either alone or in any suitable combination.

For some applications, data processing system may have an associated printer, display, and/or additional devices to facilitate monitoring of the drilling and logging operations. For many applications, outputs from data processing system will be communicated to various components associated with operating drilling rig 102 and may also be communicated to various remote locations monitoring the performance of the operations performed through directional drilling system 100.

Figure 2:
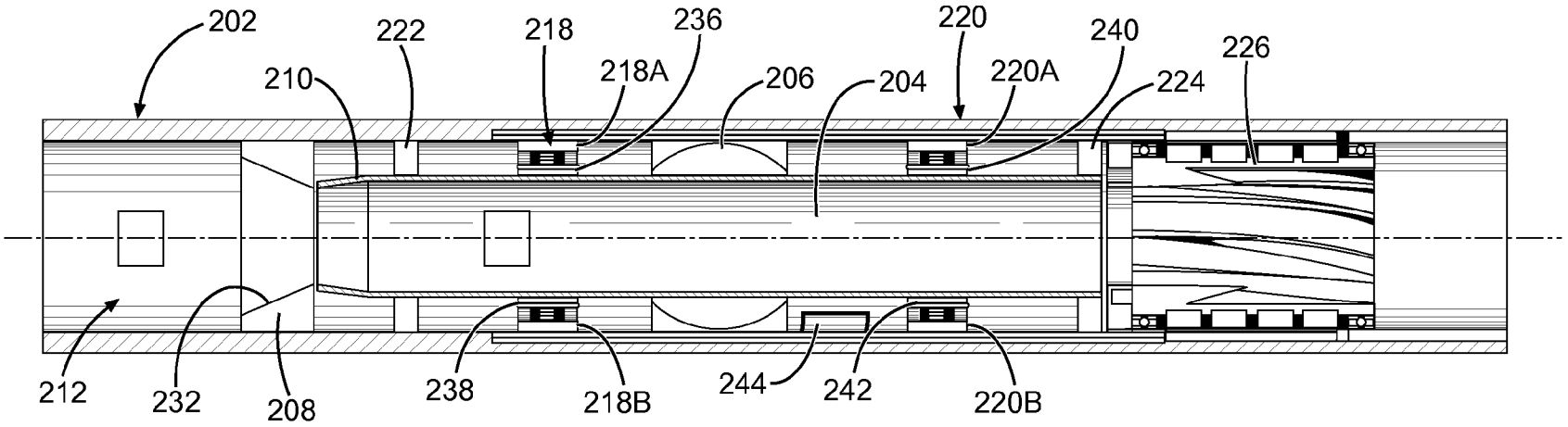
FIG. 2 depicts an example embodiment of a mud pulse generator, depicted partially in vertical section.

Referring now to FIG. 2, the figure depicts an example mud pulse generator 200. Mud pulse generator 200 includes a housing member 202 configured for use in the downhole environment. In this example, housing member 202 will be configured with pin and box threaded sections at opposing ends of the housing to threadably couple into a bottom hole assembly (as depicted at 106 in FIG. 1). The threaded connections at either end of housing member 202 are not shown, and will be of conventional construction. Mounted within housing member 202 is a central flow member 204, which is configured to receive and convey the flow of mud through mud pulse generator 200. Central flow member 204 is pivotably mounted by a bearing assembly 206, which allows central flow member 204 to rotate about an axis which extends generally perpendicular to a longitudinal axis through central flow member 204 (and housing member 202). For purposes of explanation, central flow member 204 can be visualized as rotating about an axis extending perpendicular to the view of FIG. 2, and through the center of bearing assembly 206. As a result, central flow member will pivot upwardly and downwardly within the plane of FIG. 2.

Bearing assembly 206 can be of any suitable configuration which will facilitate relatively quick rotation of central flow member 204 relative to housing member 202 to cause a series of obstructions to the flow of fluid downwardly (from left to right in FIG. 2) through mud pulse generator 200, thereby generating pulses in the downwardly flowing mud column. Accordingly, the rapidity of the ability to cause and remove the obstructions which result in the pulses is one factor determining how much data can be communicated through use of mud pulse generator 200.

In a particularly preferred embodiment, bearing assembly 206 will include a magnetic bearing assembly that will maintain central flow member 204 in a generally centralized position within housing member 202. Such magnetic bearings provide essentially frictionless support, by supporting one member of the bearing assembly within a magnetic field established by a plurality of magnetic energizing coils.

Such magnetic bearings typically include a stator assembly having a plurality of stator ring sections, each stator ring section having a respective electromagnetic assembly, such as a coil wrapped around a core. Each stator ring assembly may include for example eight, or more radially arranged sections, each having a respective electromagnet, arranged to present a magnetic field extending toward the radial center of the ring assembly. Additionally, such bearing assemblies will include a rotor component, which may include eight (or more) cores formed of a ferromagnetic material, and which extends through the stator rings, and is held, through use of the magnetic fields provided by the stator rings in generally rotatable, but generally frictionless, relationship to the stator assembly.

In the depicted example, mud pulse generator 200 includes a baffle plate 208 immediately upstream of the upper end 210 of central flow member 204. Baffle plate 208 has a central aperture 232 having a having a tapered, decreasing diameter from the relatively uphole surface to the relatively downhole surface. Baffle plate 208 thereby serves as a transition for flow from the full diameter of housing member 202 to the decreased diameter of central flow member 204. In the depicted example, central flow member 204 includes a taper proximate the upper end 210 providing an uppermost end with a relatively decreased diameter relative to a slightly downhole portion of upper end 210, and in this example, the tapering dimension of upper end 210 is also reflected on the exterior surface of upper end 210. This exterior taper is believed to facilitate deflection of central flow member 204 relative to baffle plate 208 under conditions of fluid flow therethrough. Thus, upper portion 210 serves as a transition region for flow coming through baffle plate 208.

As described above, magnetic bearing assembly 206 is configured to serve as a pivot point for angular deflection of central flow member 204 relative to housing member 202. In this example configuration, magnetic bearing assembly 206 is preferably configured to allow deflection of the longitudinal axis of central flow member 204 to a desired degree. In most configurations, deflection of approximately 10° to approximately 20° relative to the axis of housing member 202 is believed to be sufficient. However, in other configurations, deflection of up to 30°, or possibly even more may be desirable.

In order to facilitate this deflection, mud pulse generator 200 includes a pair of magnetic actuator assemblies, indicated generally at 218 and 220. Each magnetic actuator assembly 218, 220 includes one or more electromagnets, which in many examples will be secured as a stator element, such as by attachment to housing member 202 or another structure associated with housing member 202. In many examples, each magnetic actuator assembly 218, 220 will actually be formed of two actuators, 218A, 218B and 220A, 220B placed generally on diametrically opposing sides of central flow member 204. In other examples, each magnetic actuator 218, 220 can be constructed as a single unit, but will again place electromagnets in diametrically opposed positions relative to central flow member 204. Depending upon the specific structure of central flow member 204, it may be desirable to use components providing ferromagnetic plates, such as reaction plates 236, 238 and 240, 242 secured to central flow member 204, which will be responsive to magnetic fields established by one or more of opposing actuators 218A, 218B and 220A, 220B.

In some example configurations, ease of design and operation may be provided by placing magnetic actuator assemblies 218, 220 at symmetrical distances relative to magnetic bearing assembly 206. However, in other configurations, such as the depicted example, the magnetic actuator assemblies may be asymmetrically placed relative to the magnetic bearing assembly 206, in order better facilitate movement in multiple directions.

Mud pulse generator 202 also includes a pair of seal assemblies 222, 224 configured to seal between central flow member 204 and housing member 202. Seal assemblies 222, 224 are placed to prevent the well fluids from reaching the actuator assemblies, 218, 224 and bearing assembly 206, to avoid fouling of those mechanisms either by the fluids themselves, or by contaminants in the fluids. Seal assemblies 222, 224 will be configured to be resilient along at least one axis of movement of central flow member 204, as achieved in response to actuator assemblies 218, 214, to allow the described deflection of central flow member 204 relative to housing member 202.

Mud pulse generator 202 includes a turbine assembly 226 configured to generate electrical power through use of the following mud column within the assembly. Turbine assembly 226 can include any of a variety of constructions. Current assembly 226 can generate power which can be stored by a conventional battery and which can be used to power a control unit 244 operable to selectively apply power to the bearing assembly 206, if it is a magnetic bearing assembly utilizing electromagnets, and also to magnetic actuator assemblies 218, 220 in order to achieve deflection of central flow member 204 in accordance with a selected communication protocol.

Figure 3:
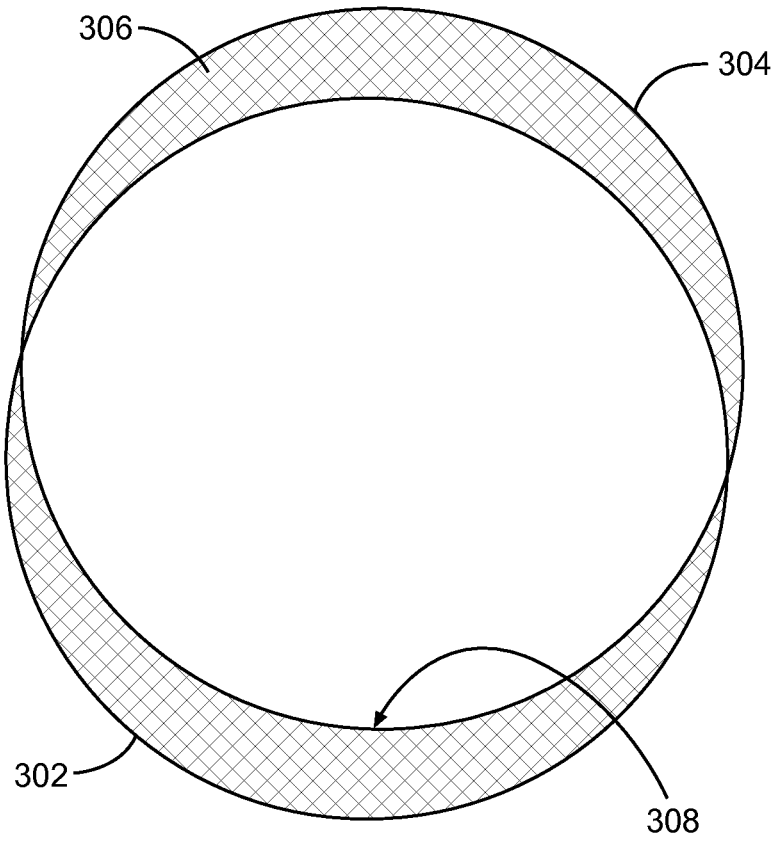
FIG. 3 depicts a schematic representation of occlusion of the fluid passage through the mud pulse generator of FIG. 2.

Referring now to FIG. 3, the figure depicts the occlusion of the flow passage 216 through central flow member 204 when central flow member 204 is deflected. In an initial position, wherein the axis of central flow member 204 is the same as the longitudinal axis of housing member 202, as depicted in FIG. 2, the flow path into central flow member 204 will be defined by the open passage between the downhole end of baffle block 206 with the uppermost end 210 of central flow member 204. In many examples, such as that depicted in FIG. 2, the adjacent diameters of both apertures will be approximately equal, and thus can be defined by a single circular aperture, as schematically depicted at 302 in FIG. 3. When central flow tube 204 is deflected, the relative apertures between 204 and baffle plate 206 will fall out of alignment, with part of upper end 210 moving to an upper position, as indicated at 304, and will be blocked by baffle plate 208 providing a first region of occlusion indicated generally at 306. Simultaneously, on the diametrically opposed surface, fluid will be prevented from flowing directly through into central flow member 204 as the opposite surface indicated generally at 308 will move upwardly relative to the lowermost dimension of aperture 232 in baffle plate 208. In the indicated design, this occlusion is not a complete barrier to flow, as there will be a blockage of further flow past the lower surface by seal assembly 222. However, the occlusion provided cooperatively by the offset placement of upper end 210 relative to aperture 232 and the seal assembly 222 will result in an increase of pressure of the fluid at baffle plate 208 and above. In alternative configurations, a separate annular flow channel might be provided around central flow member 204 to allow passage of fluid around the actuation assemblies and bearing, as described above. In that instance, the actuation assemblies and bearings would be coupled to a mandrel extending within a housing member 202, and defining an annular region (or a portion of such an annular region) through which drilling fluid may flow either to engage the turbine, or to a positioned downhole of the turbine 226.

Figure 4:
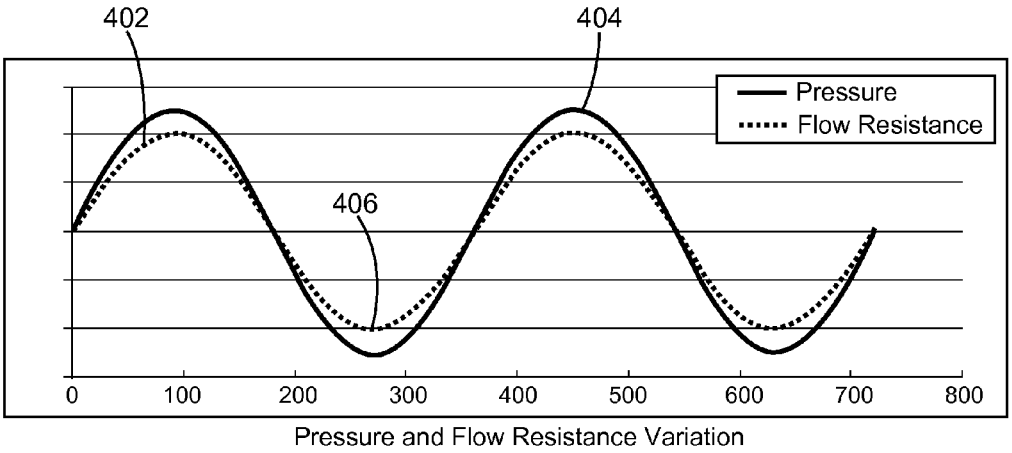
FIG. 4 depicts an example curve reflecting the change in resistance to flow of a fluid column through a fluid passage with the resulting pressure in that fluid column.

Referring now to FIG. 4, the figure graphically depicts the correlation between resistance to flow, as reflected by curve 402, and the pressure established within the drillstring above baffle plate 206, as indicated by curve 404. The resistance to flow causes a buildup of pressure in the drill string above the nominal pressure being applied both by pumping of the drilling fluid and by the weight of the fluid column itself above mud pulse generator 200. As will be apparent to persons skilled in the art having the benefit of this disclosure, the lowest flow resistance, as indicated at 406, will be achieved when central flow member 204 is longitudinally aligned with housing member 202 (and as a result, in the depicted embodiment, with baffle plate 208).

Figure 5:
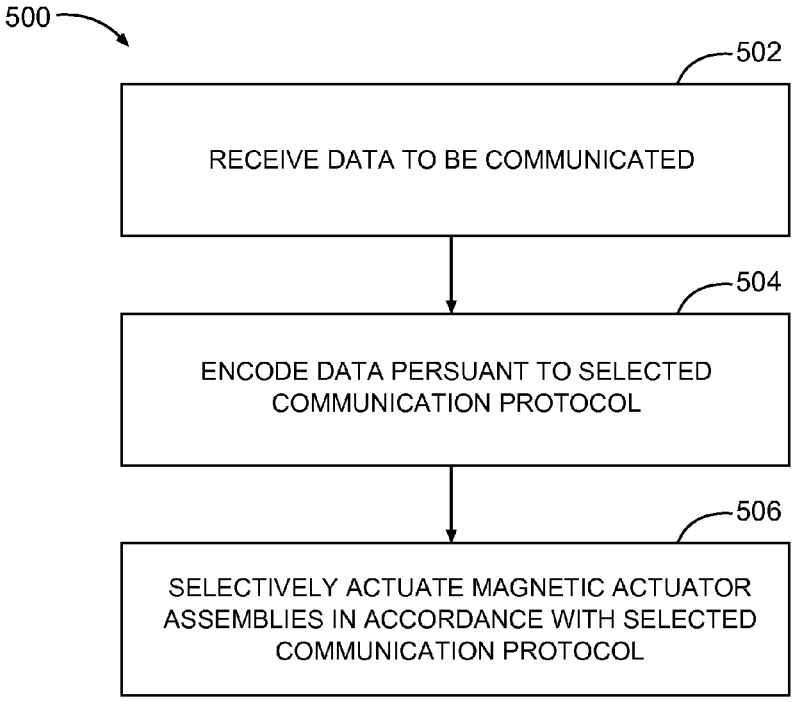
FIG. 5 depicts an example flow chart of an example method of operating the mud pulse generator as depicted in FIG. 2.

Referring now to FIG. 5, the figure depicts a high level flow chart 500 of one example method of operation of mud pulse generator 200. As a first step, a controller assembly will receive data to be communicated. This receiving of data may be performed in another mechanism such as an MWD or LWD tool in the tool string, or by another control assembly, such that the data may be gathered for transmission by mud pulse generator 200. Preparing the data for communication will typically include encoding the data pursuant to a selected communication protocol as indicated at 504. Any of a wide variety of communication protocols for communicating data through multiple systems, including FSK, PSK, ASK and combinations of the above, as well as other communication protocols. An appropriate controller will then selectively apply power to one or more of magnetic actuation assemblies 218, 220 to cause deflection of central flow member 204 as described above, in accordance with the selected communication protocol, and an established data rate. In some example implementations, central flow member 204 may be deflected essentially only between two positions, a relative "on" position, with a maximum flow passage into central flow member 204, and a relative "off" position with a selected degree of occlusion of such fluid flow. However, additional states may be implemented, where central flow member 204 is deflected to one or more intermediate positions between the full "on" position and the full (relative) "off" position, thereby providing not only a variability in pulse duration and frequency, but also in pulse height.

Many variations may be made in the structures and techniques described and illustrated herein without departing from the scope of the inventive subject matter. For example, in some systems the central flow member might be moved to a deflected position through use of a magnetic actuator, but returned to a starting position by a mechanical mechanism, such as a spring. Accordingly, the scope of the inventive subject matter is to be determined only by the scope of the following claims, and the equivalents thereof.

We claim:

1. A fluid pulsing apparatus, comprising:

a housing assembly;

a flow conduit supported within and in pivotal relation to the housing assembly; and a first magnetic assembly in operative communication with the flow conduit, the magnetic assembly operable to pivot the flow conduit between a first position and a second position.

2. The fluid pulsing apparatus of claim 1, further comprises a bearing assembly supporting the flow conduit within the housing assembly and in pivotal relation to the housing assembly.

3. The fluid pulsing apparatus of claim 2, wherein the bearing assembly comprises a magnetic bearing assembly.

4. The fluid pulsing apparatus of claim 1, wherein the first magnetic assembly comprises a pair of electromagnets supported in diametrically opposed locations relative to the flow conduit.

5. The fluid pulsing apparatus of claim 1, further comprises a second magnetic assembly longitudinally offset along the flow conduit relative to the first magnetic assembly, and wherein the second magnetic assembly comprises a pair of electromagnets supported in diametrically opposed locations relative to the flow conduit.

6. The fluid pulsing apparatus of claim 5, wherein a first electromagnet of each of the first and second magnetic assemblies are aligned relative to a longitudinal plane extending along the flow tube and along the longitudinal axis of the flow tube.

7. The fluid pulsing apparatus of claim 1, further comprising a baffle member configured to direct fluid into the flow conduit.

8. A method for generating pulse signals in a flowing fluid column, comprising:

directing the flowing fluid column through a downhole tool within a tool string, the downhole tool having a housing;

directing at least a portion of the flowing fluid column within the housing through a flow passage within a movable structure, the movable structure configured for movement between at least a first position and a second position relative to the housing, wherein in the second position below is restricted through the movable structure relative to when the movable structure is in the first position; and magnetically moving the movable structure between the first and second positions to generate pulses in the flowing fluid column.

9. The method of claim 8, wherein the movable structure comprises an elongated conduit defining the flow passage.

10. The method of claim 9, further comprising a first and second magnetic actuators in spaced relation to one another along the elongated conduit, and wherein the step of magnetically moving the movable structure between the first and second positions comprises actuating the first and second magnetic actuators.

11. The method of claim 10, wherein the first and second magnetic actuators each comprises at least one electromagnet.

12. The method of claim 9, wherein the elongated flow conduit is supported by a magnetic bearing assembly.

13. A downhole system, comprising:

a drillstring, the drillstring comprising, a length of drill pipe;

a logging tool;

a drill bit coupled at the bottom end of the drillstring; and a mud pulse generator, the mud pulse generator comprising:

a housing assembly coupled into the drillstring:

a linear flow conduit pivotably coupled within the housing, the linear flow conduit defining a flow passage and arranged for the linear flow conduit flow passage to receive at least a portion of fluid flowing through the drillstring; and at least one actuator assembly arranged to move the linear flow conduit between a first position and a second position in which flow through the linear flow conduit is partially blocked relative to when the flow conduit is in the first position.

14. The downhole system of claim 13, wherein the mud pulse generator further comprises a controller configured to operate the at least one actuator assembly to move the linear flow conduit to establish a plurality of pressure pulses in fluid within the drillstring.

15. The downhole system of claim 14, wherein the plurality of pressure pulses is configured to communicate information in accordance with a selected communication protocol.

16. The downhole system of claim 15, wherein the information comprises data from the logging tool in the drillstring.

17. The downhole system of claim 13, wherein the linear flow conduit is pivotably coupled within the housing through use of a magnetic bearing assembly.

18. The downhole system of claim 17, wherein the at least one actuator assembly comprises a plurality of actuator assemblies, and where the plurality of actuator assemblies are magnetic actuator assemblies.

19. The downhole system of claim 18, wherein the plurality of magnetic actuator assemblies comprises at least one magnetic actuator assembly relatively uphole of the magnetic bearing assembly and at least one magnetic actuator assembly relatively downhole of the magnetic bearing assembly.

20. The downhole system of claim 19, wherein at least one magnetic actuator assembly comprises a first magnetic actuator and a second magnetic actuator, with the first and second magnetic actuators placed on diametrically opposed sides of the linear flow conduit.

* * * * *